US005509828A

United States Patent [19]

Muta et al.

[11] Patent Number: 5,509,828

[45] Date of Patent: Apr. 23, 1996

[54] L-SHAPED BULB SOCKET

[75] Inventors: Junji Muta; Yoshiaki Furuta, both of Yokkaichi, Japan

[73] Assignee: Sumitomo Wiring Systems, Ltd., Japan

[21] Appl. No.: 344,489

[22] Filed: Nov. 23, 1994

[30] Foreign Application Priority Data

| | | | |
|---|---|---|---|
| Nov. 25, 1993 | [JP] | Japan | 5-320945 |
| Dec. 10, 1993 | [JP] | Japan | 5-341431 |

[51] Int. Cl.[6] ..... H01R 13/436

[52] U.S. Cl. ..... 439/699.2; 439/752

[58] Field of Search ..... 439/699.2, 752

[56] References Cited

U.S. PATENT DOCUMENTS

| | | | |
|---|---|---|---|
| 4,752,241 | 6/1988 | Matsuoka et al. | 439/699.2 |
| 5,000,702 | 3/1991 | Forish et al. | 439/699.2 |
| 5,080,615 | 1/1992 | Kondo | 439/699.2 |

FOREIGN PATENT DOCUMENTS 137588 8/1987 Japan .

*Primary Examiner*—Gary F. Paumen
*Attorney, Agent, or Firm*—Jordan B. Bierman; Bierman and Muserlian

[57] ABSTRACT

A retainer 16 is temporarily coupled to an inlet port of a connector chamber 7 in a housing 5 so that the retainer cannot come out of the chamber 7. A terminal metal fixture (metal terminal) 1 is inserted into the housing 5 through an opening formed in a rear wall of the housing in an axial direction of a bulb holding chamber 6. Then, the retainer 16 which is temporarily coupled to the chamber 7 is pushed into the connector chamber which receiving coupling pieces 3 of the fixtures 1 in holding apertures 17 in the retainer 17. When the retainer 16 reaches an inner section in the chamber 7, a lock projection 18 on the retainer engages with a lock face 14 in a longitudinal slot 12 formed in the rear wall of the housing 5, thereby bringing the retainer into a regular coupling position. Proximal ends of the coupling pieces 3, which is arranged perpendicularly to an inserting direction of the fixtures 1, are fitted in the holding apertures 17 in the retainer 16 which is secured in the housing 5. The retainer 16 is provided on its inner face of a side plate 28 with a guide slant face 281 a lower end of which is contiguous to rear end edges of the apertures 17. The apertures 17 are provided on their front, right and left end edges with guide slant faces 26. After the fixtures 1 are inserted into the housing 5 from its rear side, the retainer is pushed into the connector chamber 7 through the inlet port of the chamber 7. If the fixtures 1 are shifted, the fixtures 1 are corrected in position while the distal ends of the coupling pieces 3 contact with the guide slant faces 281 or 26 to insert them into the apertures 17. The retainer 16 is secured in the housing 5 when it reaches the inner section of the chamber 7.

2 Claims, 5 Drawing Sheets

L-SHAPED BULB SOCKET

BACKGROUND OF THE INVENTION (1) Field of the Invention

This invention relates to an L-shaped bulb socket in which a bulb and a mating connector are perpendicularly interconnected.

(2) Statement of the Prior Art

Heretofore, for example, a light device for an automobile has utilized an L-shaped bulb socket, which accommodates terminal metal fixtures (metal terminals) having a pair of bulb receiving pieces adapted to hold each terminal of a bulb and a coupling piece adapted to be connected to each terminal of a mating connector and joined perpendicularly to the bulb receiving pieces and in which the bulb and mating connector are interconnected perpendicularly.

Such a conventional L-shaped bulb socket is generally made by insert-molding the terminal metal fixtures. However, a process of producing the socket requires much labor. Thus, a method of assembling the socket has been developed. An example thereof is disclosed in Japanese Utility Model Publication No. 62-137588 (1987).

For convenience of explanation, a conventional L-shaped bulb socket will be described below by referring to FIGS. 7 and 8. FIG. 7 is a longitudinal sectional view of the conventional L-shaped bulb socket and FIG. 8 is a front elevational view taken along lines VIII—VIII in FIG. 7.

As shown in FIGS. 7 and 8, the L-shaped bulb socket is provided in its L-shaped housing a with a bulb holding chamber b and a connector chamber c arranged perpendicularly to the bulb holding chamber b. The housing a is provided in its front portion with slots d which extend from the bulb holding chamber b to the connector chamber c. Terminal metal fixtures e are pushed into the housing a through the slots d. When an elastic lock piece g projected from a side face of bulb receiving portions b of each terminal metal fixture e engages with a recess h formed in a side wall of the bulb holding chamber b, the fixture e is secured in the housing a.

However, since the conventional L-shaped bulb socket prevents the terminal metal fixture e from coming out of the housing a by a projection and recess fitting mechanism on a plane along a inserting direction of the terminal metal fixture e, the fixture e easily vibrates in the inserting direction in the housing a and easily falls down out of the housing a. Consequently, for example, when the bulb is attached to the socket, a distance from the distal end of the socket to a filament in the bulb is changed in each socket.

Also, a substantial resistance will occur when the elastic lock pieces g of the terminal metal fixture e is pushed into the housing a while being elastically deformed. This will result in a half insertion of the fixture e in the housing a. It is impossible to detect the half insertion of the fixture during an assembly step.

Further, in the conventional L-shaped bulb socket, since the terminal metal fixture e is merely pushed into an inner section in the slot d, positioning of the fixture becomes inaccurate and holding of the fixture becomes inadequate.

SUMMARY OF THE INVENTION

An object of the present invention is to provide an L-shaped bulb socket which prevents terminal metal fixtures (metal terminals) from being exposed and can positively hold the fixtures.

Another object of the present invention is to provide an L-shaped bulb socket which can correctly position the terminal metal fixtures while automatically correcting a positional divergence of the fixture.

In order to achieve the above objects, an L-shaped bulb socket of the present invention comprises: a housing having a bulb holding chamber, a connector chamber, a fixture insertion opening formed in a side wall of the connector chamber, and a retainer inlet port formed in a bottom wall of the connector chamber, the holding chamber being arranged in perpendicular to the connector chamber in the housing; a pair of terminal metal fixtures disposed in the chambers, each of the terminal metal fixtures having a pair of bulb receiving pieces adapted to hold each terminal of a bulb and a coupling piece adapted to be connected to each terminal of a connector, the coupling piece being perpendicularly joined to the bulb receiving pieces; and a retainer inserted through the retainer inlet port into an inner part of connector chamber to be secured therein, the retainer being provided with apertures through which the respective coupling pieces pass.

The retainer may be provided with a side plate having a guide slant face which guides distal ends of the terminal metal fixtures to the respective apertures.

Each of terminal metal fixtures are accommodated in the bulb holding chamber and connector chamber in the housing while the coupling piece of the fixture is being inserted through the opening in the side wall of the connector chamber. Thereafter, the retainer is inserted into the inner section in the connector chamber through the retainer inlet port in the connector chamber while the coupling pieces are being inserted into the apertures in the retainer. Then, the retainer is secured in the housing.

The terminal metal fixtures cannot come out from the housing because the coupling pieces are press-fitted in the holding apertures in the retainer.

In the case where the retainer has the guide slant face, when the retainer enters the connector chamber through its inlet port while sliding on its walls after the terminal metal fixtures are inserted in the inner sections in the housing, the distal ends of the fixtures contact with the guide slant face during advancing of the fixtures thereby correcting the positional divergence of the fixtures. When the retainer reaches the inner sections in the connector chamber the terminal metal fixtures are accurately positioned and secured in the housing.

According to the present invention, since preventing detachment of the terminal metal fixtures can be carried out by attachment of the retainer in the direction perpendicular to the inserting direction of the fixtures, it is possible to eliminate plays between the fixtures and the housings and to positively assemble the socket. Thus, for example, when the bulb is attached to the socket, it is possible to dispose the filament in the bulb at the correct position.

Even if the terminal metal fixtures are incompletely fitted in the housing, it is possible to detect the half fitting state of the fixtures during the assembling step because the coupling pieces of the fixtures do not enter the apertures in the retainer when the retainer advances in the connector chamber.

Further, according to the present invention, it is possible to automatically correct the positional divergence of the fixtures, thereby disposing the fixtures at the correct positions. Since the retainer through which the fixtures pass is held by the surrounding walls in the connector chamber, the retainer can positively hold the fixtures in the housing.

Figure 1:
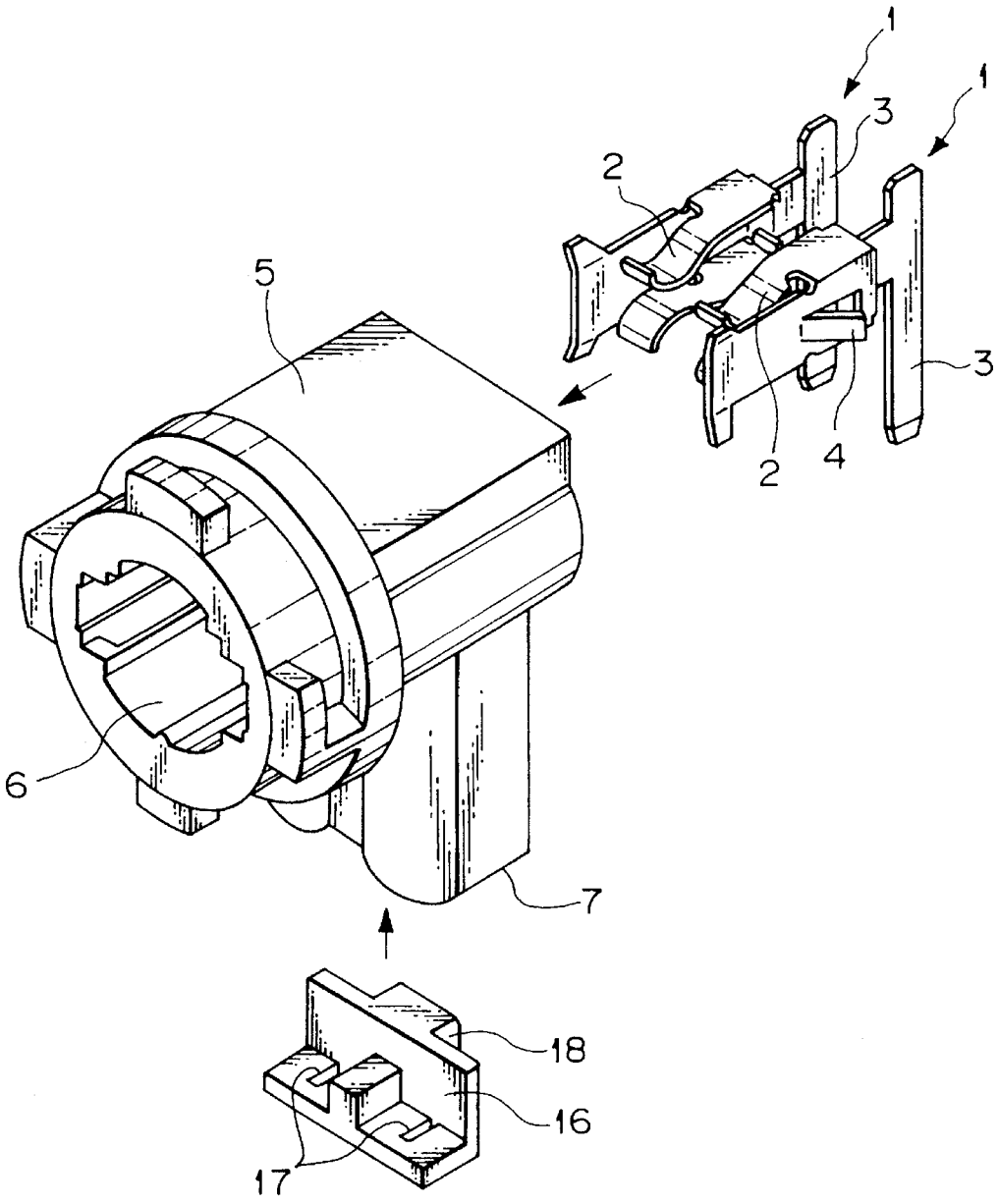
FIG. 1 is an exploded perspective view of a first embodiment of an L-shaped bulb socket in accordance with the present invention.
Figure 2:
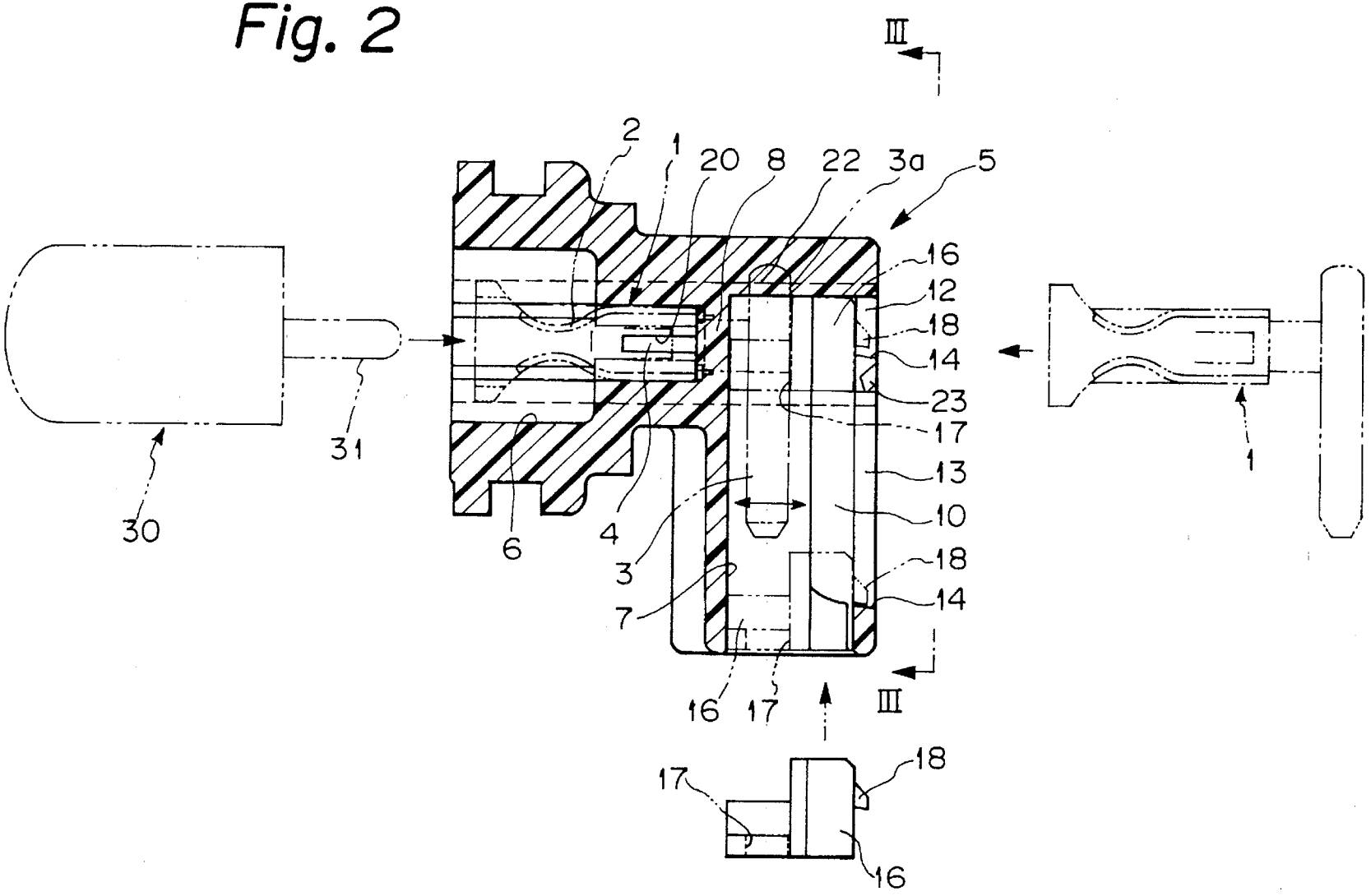
FIG. 2 is a longitudinal sectional view of the first embodiment of the L-shaped bulb socket shown in FIG. 1.
Figure 3:
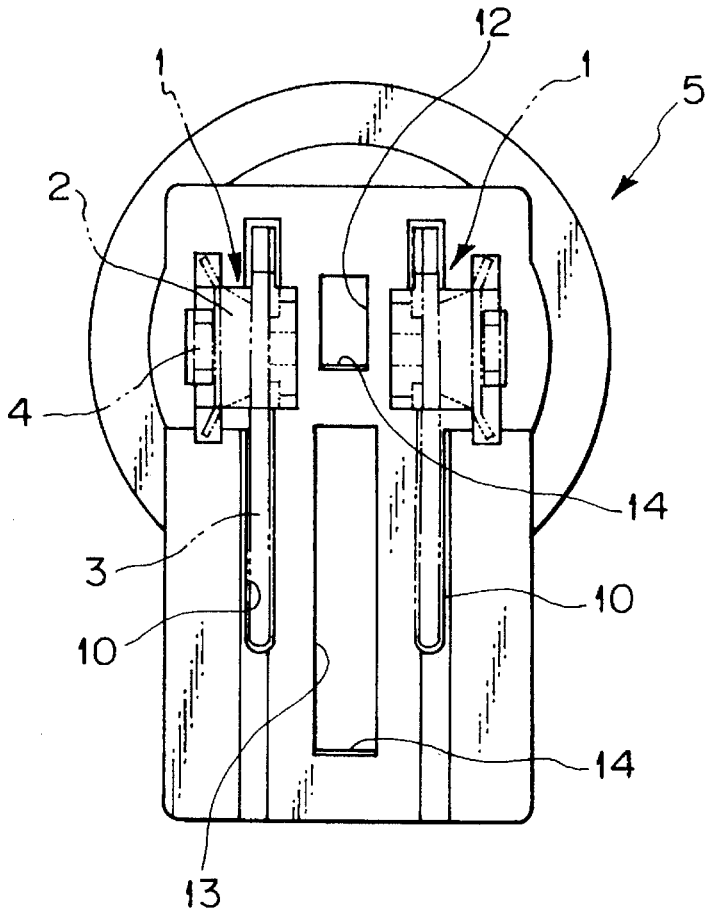
FIG. 3 is a rear elevational view of the L-shaped bulb socket taken along lines III—III in FIG. 2.
Figure 4:
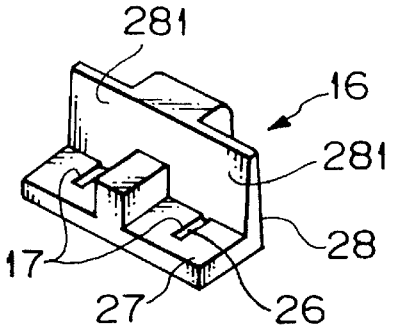
FIG. 4 is a perspective view of a retainer in a second embodiment of the present invention.
Figure 5:
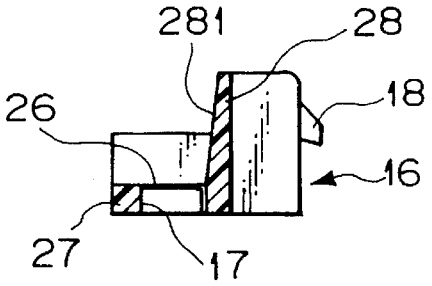
FIG. 5 is a longitudinal sectional view of the retainer shown in FIG. 4.

DETAILED DESCRIPTION OF THE PREFERRED EMBODIMENTS:

Referring now to FIGS. 1 to 3, a first embodiment of an L-shaped bulb socket of the present invention will be described below.

Each of a pair of terminal metal fixtures (metal terminals) 1 includes a pair of bulb receiving pieces 2 adapted to clamp a terminal 31 of a bulb 30 (see FIG. 2) and a male coupling piece 3 joined perpendicularly to the pieces 2 to form an L-shaped configuration.

The coupling piece 3 has a convergent taper at its distal end. Each bulb receiving piece 2 has an elastic piece 4 which projects outwardly from the outer face of the piece 2.

A housing 5 made of a synthetic resin material is formed into an L-shaped configuration. The housing 5 is provided in its interior with a bulb holding chamber 6 and a connector chamber ? which is arranged perpendicularly to the chamber 6. The bulb chamber is divided at its inner part into right and left sections by a partition 8.

As shown in FIG. 3, the connector chamber 7 in the housing 5 is provided in its rear wall with right and left openings 10 through which each fixture 1 is inserted into the chamber in an axial direction of the bulb holding chamber 6.

A short vertical groove 12 and a long vertical groove 13 are formed between the openings 10 in the rear wall of the connector chamber ? . Both grooves 12 and 13 are provided on their lower end with inwardly raising slant faces 14.

A retainer 16 made of a synthetic resin material is inserted into the housing 5 in order to prevent the metal fixtures 1 from being detached from the housing 5. The retainer 16 has a configuration suitable for entering the connector chamber 7 in the housing 5 through an inlet port while maintaining its certain posture. The retainer 16 is provided with two holding apertures 17 spaced away from each other by a given distance and adapted to receive the respective coupling pieces 3 of the terminal metal fixtures 1. The retainer is also provided on its side face opposed to an inner face of the rear wall of the connector chamber 7 with a lock projection 18 which is adapted to engage with the vertical grooves 12 and 13 and has an outwardly down slant face.

The bulb holding chamber 6 is provided in its opposite side walls with recesses 20 into which the respective elastic pieces 4 on the bulb receiving pieces fall when the fixtures 1 are inserted into given positions in the housing 5.

Next, steps of assembling the socket of the present invention will be described below.

First, when the retainer 16 is pushed into the inlet port in the connector chamber 7 in the housing 5 against an elastic force of the synthetic resin material, the lock projection 18 falls in the lower vertical groove 13 and engages with the lower slant face 14 not to come out of the chamber 7, thereby bringing the retainer 16 into a temporary fitting state, as shown by two-dot chain lines in FIG. 2.

Then, each terminal metal fixture 1 is inserted into the housing through the corresponding opening 10 in the rear wall of the housing 5 in the axial direction A (FIG. 2) of the bulb holding chamber 6 while the elastic pieces of the bulb receiving pieces 2 are elastically deformed on the way to the inner section in the connector chamber 6. When an extending portion 3*a*, which projects from a crossing portion between the bulb receiving pieces 2 and the coupling piece 3, reaches a ceiling 22 in the opening 10, the fixture 1 is stopped in the housing 5. At this time, the elastic piece 4 falls in the recess 20 in the side wall of the chamber 6 by its elastic recovery force, thereby preventing the fixture 1 from detaching from the housing 5. This makes a first stage of preventing detachment of the fixtures. Then, the bulb receiving pieces 2 and coupling pieces 3 of the fixtures 1 are accommodated in the bulb holding chamber 6 and connector chamber 7 while maintaining their given postures therein.

Next, when the retainer 16, which is temporarily fitted in the connector chamber 7, is further pushed into the chamber 7, the coupling piece 3 of each terminal metal fixture 1 is inserted into the corresponding aperture 17 in the retainer while the tapered distal end of the piece 3 is guiding the piece 3. When the retainer 16 reaches the inner section in the connector chamber 7, the lock projection 18 moves over a wall 23 between the upper and lower vertical grooves 12 and 13 so that it falls in the upper vertical groove 12 to engage with the lower end slant face 14, thereby bringing the retainer into a regular fitting position in the chamber 7. Thus, a second stage of preventing the detachment of the fixtures 1 is completed.

The terminals 31 of the bulb 30 are inserted into the bulb holding chamber 6 in the L-shaped bulb socket thus constructed while a mating female connector is inserted into the connector chamber 7.

In the L-shaped bulb socket of the present invention, since the proximal end of the coupling piece 3 which is set to be perpendicular to the inserting direction of the terminal metal fixture 1 is fitted in the aperture 17 in the retainer 16 secured in the housing 5, the fixture 1 does not vibrate in the housing 5 and is prevented from being detached from the housing.

For example, upon attaching the bulb to the socket, a distance from the open end of the bulb holding chamber 6 to a filament in the bulb becomes constant.

If the fixture 1 is at a half fitting position in the housing 5, the coupling piece 3 of the fixture 1 does not enter the aperture 17 when the retainer 16 is pushed into the inner section in the connector chamber 7. This will suggest that the fixture 1 is in the half fitting state. Consequently, it is possible to effect again an inserting operation of the fixture to get a correct assembly.

It is possible to detect a misalignment of both coupling pieces 3 in the housing 5.

An inserting direction of the terminal metal fixture may be any one in the side wall of the connector chamber 7.

Means for securing the retainer 16 in the inner section in the connector chamber 7 are not limited to those in the above embodiment but may utilize another locking means.

Although the terminal metal fixture 1 has the male coupling piece 3 in the above embodiment, it may have a cylindrical female coupling piece. In this case, circular apertures may be formed in the retainer 16 so as to receive the cylindrical female coupling pieces.

Next, a second embodiment of an L-shaped bulb socket of the present invention will be explained by referring to FIGS. 4 through 6A and 6B. Feature of the second embodiment resides in a configuration of the retainer 16. The other constructions are the same as those in the first embodiment.

A side plate 28 of the retainer 16 has a thickness which becomes thinner toward its upper free end to form an inner guide slant face 281. A lower end of the guide slant face 281 is contiguous to a rear end edge of the aperture 17. Also, each aperture 17 is provided on its front, right and left edges with guide slant faces 26.

Figure 6A:
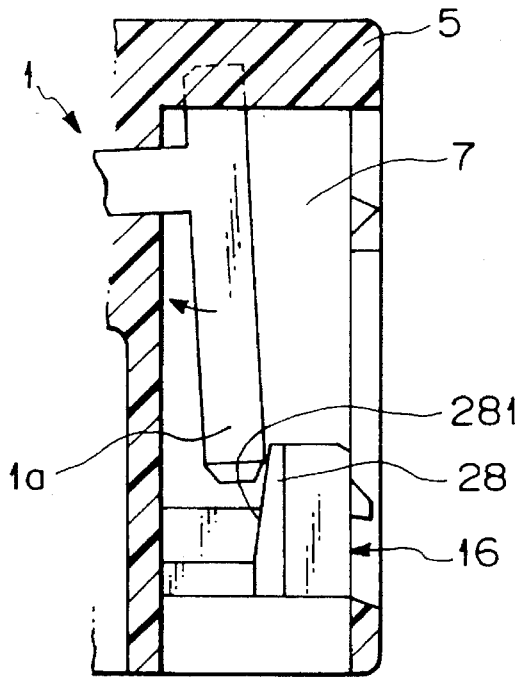
FIGS. 6A and 6B are explanatory views illustrating operations of the retainer shown in FIG. 4.
Figure 6B:
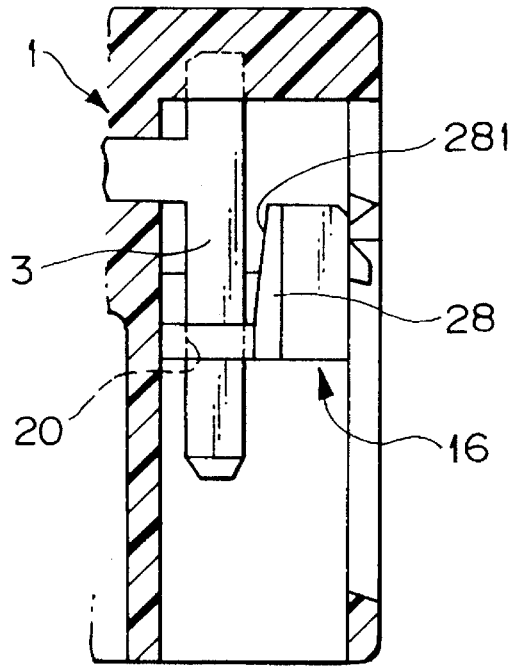
Figure 8:
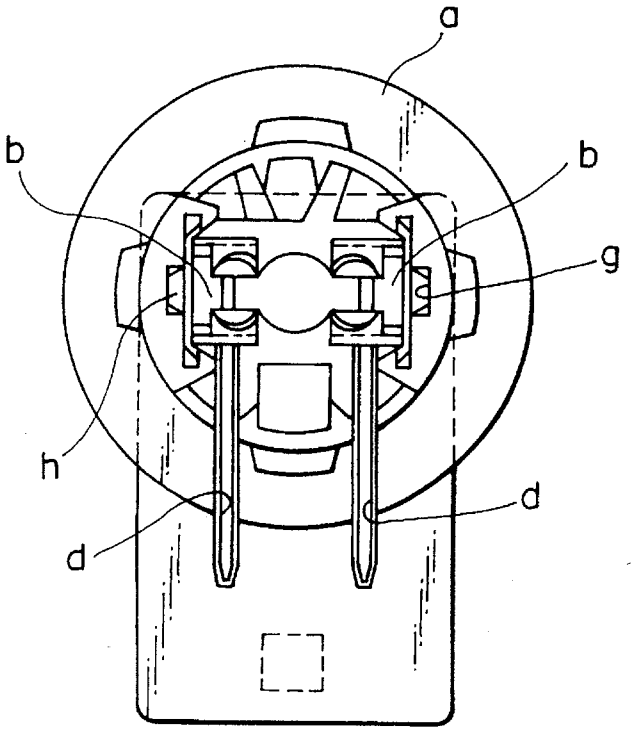
Fig. 8 PRIOR ART
FIG. 8 is a front elevational view of the conventional L-shaped bulb socket taken along lines VIII—VIII in FIG. 7.
Figure 7:
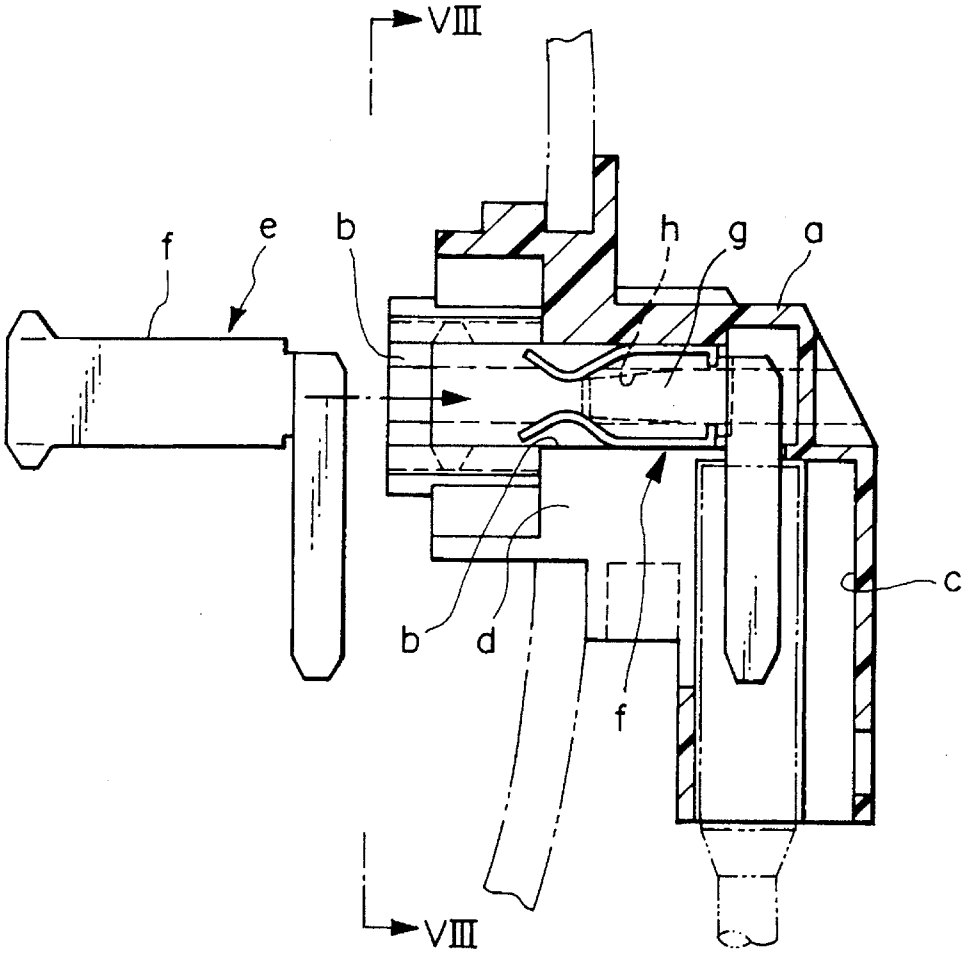
Fig. 7 PRIOR ART
FIG. 7 is a longitudinal sectional view of a conventional L-shaped bulb socket.

When the retainer 16 is pushed from the temporary fitting position to a further inner position in the connector chamber 7, the distal end of the coupling piece 3 abuts on the guide slant face 281 on the side plate 28 of the retainer 16 if the terminal metal fixture 1 is shifted from the regular position to, for example, a position in the counterclockwise direction as shown in FIG. 6A. Then, the terminal metal fixture 1 is turned to the clockwise direction shown in FIG. 6B by the guide slant face 281 to correct the posture of the fixture 1. Thus, the distal end of the coupling piece 3 is received in the aperture 17.

In the case where the fixture 1 is shifted rearwardly, the posture of the fixture 1 is corrected when the distal end of the coupling piece abuts on the guide slant face 281.

In the case that the fixture 1 is turned to a position in the clockwise direction or it is shifted forwardly in its inserting direction, the guide slant face 26 on the front, right or left edge of the aperture 17 in the retainer 16 can position the fixture 1 correctly.

When the retainer 16 is pushed into the inner section in the connector chamber 7, the lock projection 18 moves over the wall 23 between the upper and lower vertical grooves 12 and 13 and falls in the upper vertical groove 12 to engage with the lower end slant face 14, thereby bringing the retainer 16 into the regular fitting position.

Thus, according to the present invention, it is possible to arrange the terminal metal fixture 1 at a correct position and to surely secure it in the housing 5. Since the positional correction of the fixture 1 is automatically effected by the pushing operation of the retainer 16, it is not necessary to repeat the insertion of the fixture 1, thereby enhancing an efficiency of work.

What is claimed is:

1. An L-shaped bulb socket comprising:

a housing having a bulb holding chamber, a connector chamber, a terminal insertion opening formed in a side wall of said connector chamber, and a retainer inlet port formed in a bottom wall of said connector chamber, said holding chamber being perpendicular to said connector chamber in said housing;

a pair of metal fixtures disposed in said chambers, each of said metal fixtures having a pair of bulb receiving pieces adapted to hold a respective terminal of a bulb and a coupling piece adapted to be connected to each terminal of a mating connector, said coupling piece being perpendicularly joined to said bulb receiving pieces; and a retainer inserted through said retainer inlet port into an inner part of said connector chamber to be secured therein, said retainer being provided with apertures through which the respective coupling pieces pass.

2. An L-shaped bulb socket according to claim 1, wherein said retainer is provided with a side plate having a guide slant face which guides distal ends of said metal fixtures to the respective apertures.

* * * * *